United States Patent [19]

Brogie

[11] 4,456,291

[45] Jun. 26, 1984

[54] DOOR PROP

[76] Inventor: Earl W. Brogie, Box 336, Warrenville, Ill. 60555

[21] Appl. No.: 297,088

[22] Filed: Aug. 28, 1981

[51] Int. Cl.[3] ..... E05C 17/16

[52] U.S. Cl. ..... 292/338; 292/DIG. 15

[58] Field of Search ..... 292/DIG. 15, 338, 339, 292/262

[56] References Cited

U.S. PATENT DOCUMENTS

| | | | |
|---|---|---|---|
| 823,501 | 6/1906 | Beall | 292/338 |
| 1,721,257 | 7/1929 | Myers | 292/338 |
| 1,820,486 | 8/1931 | Patrick et al. | 292/338 |
| 1,847,705 | 3/1932 | Yorger | 292/338 |

FOREIGN PATENT DOCUMENTS

| | | | |
|---|---|---|---|
| 1251628 | 12/1960 | France | 292/338 |
| 611569 | 11/1948 | United Kingdom | 292/338 |

*Primary Examiner*—Richard E. Moore

[57] ABSTRACT

A prop for bracing against a door, so as to prevent opening by an intruder, the present patent application including two designs of the invention, each design including a channel secured to a door under the door knob and a brace pivotably supported from the channel, and in order that a lower end of the brace reaches the floor for bracing thereagainst, one design includes slots in the channel along which a pivoted end of the brace is slidable while the other design has the brace made telescopic.

2 Claims, 4 Drawing Figures

DOOR PROP

This invention relates generally to door holders for keeping a door in closed position and preventing it from opening.

It is well known that numerous door stops have been developed in the past so to hold a door closed, but all seem to have the disadvantage of requiring a person to bend down for setting or releasing it, or else must be foot-operated so to be reached.

A principal object of the present invention is to provide a door prop that can be operated by a person's hand without the necessity of bending down to do it.

Figure 1:
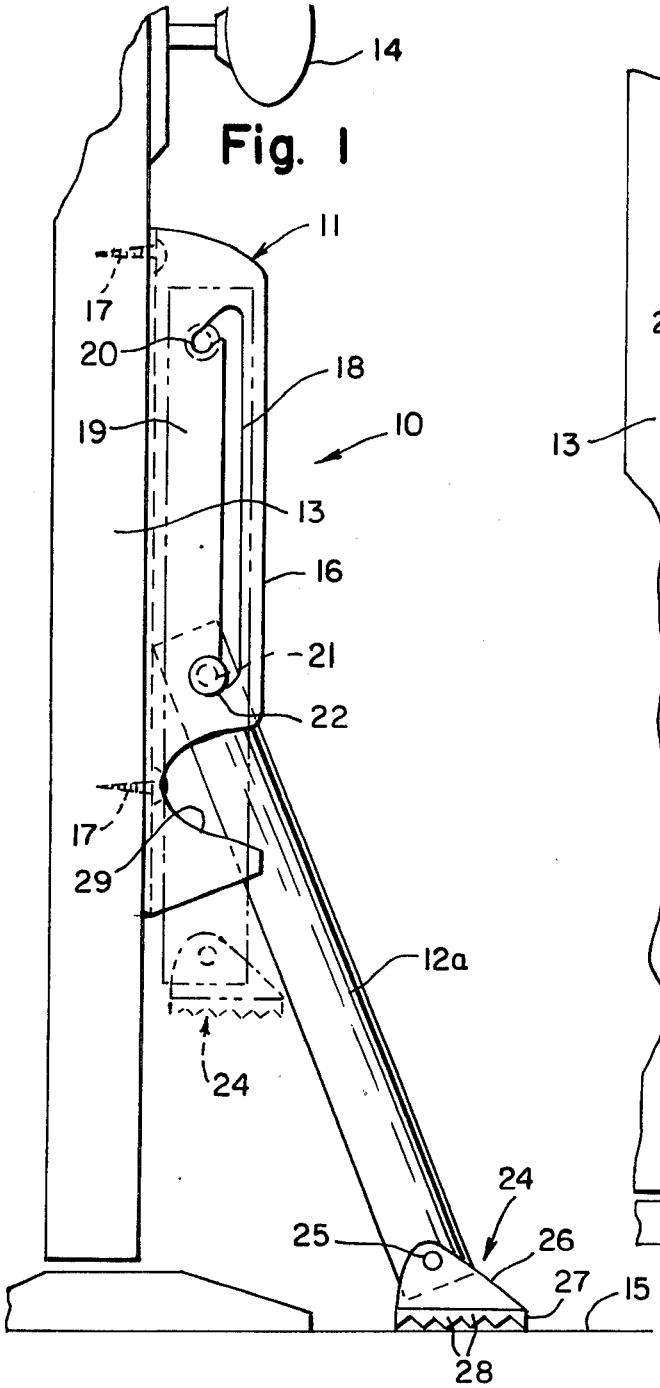
FIG. 1 is a side view of one design of the invention, shown installed on a door.
Figure 3:
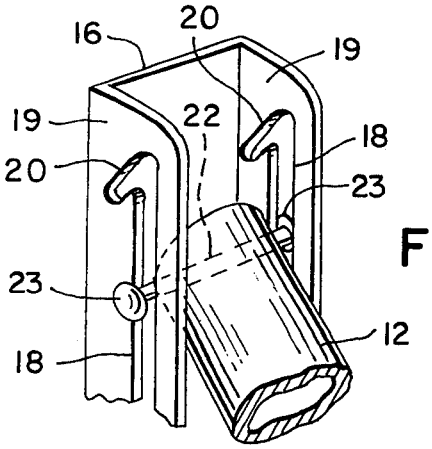
FIG. 3 is a fragmentary perspective view of the operative structure of the invention model shown in FIG. 1.

Referring now to the drawing in greater detail, and more particularly to FIGS. 1 and 3 thereof at this time, the reference numeral 10 represents a door prop according to the present invention, wherein there is a stationary base 11 for supporting a pivotable brace 12, the base being securable to one side of a door 13, and immediately under the door knob 14 thereof, and the brace being adjustable on the base in order that it may be wedged against a floor 15.

The base 11 includes a channel 16 secured to the door by means of a pair of screws 17. A vertical slot 18 is cut out in each opposite end wall 19 of the channel. An upper end of each slot has a short, augularly downward extending terminal end 20, while a lower end of each slot has short, horizontal, terminal end 21 extending at right angle to the slot, both terminal ends 20 and 21 being made in a direction toward the door against which the channel is mounted.

The brace 12 is made from a strong metal tubing of a size so to fit into the channel between the end walls 19. A cross pin 22 installed transversely through the brace, near one end thereof, also extends so to fit into the slot of each of the channel end walls, and each opposite end of the cross pin has an enlarged rounded head 23, so to prevent the cross pin from disengaging with the slots. The opposite end of the brace has a foot consisting of a U-shaped sheet metal member 26 having a rubber pad 27 adhered to its underside, the pad being molded with downward teeth 28 for bearing against the floor.

In use, (as shown by the solid lines in FIG. 1,) the brace is dropped to a lower end of theslots so to extend angularly against the floor against which it is braced.

The cross pin locks in the terminal ends 21 of the slots so to hold the brace firmly in place. When not in use, (as shown by the phantom lines in FIG. 1), the brace is simply lifted so that the cross pin rests in the slot terminal ends 20 thus keeping the foot off the floor, while the brace hangs downward in the channel. A notch 29 in each end wall of the channel allows access for grasping the brace and pivoting out of the channel when wishing to again use the door prop.

Figure 2:
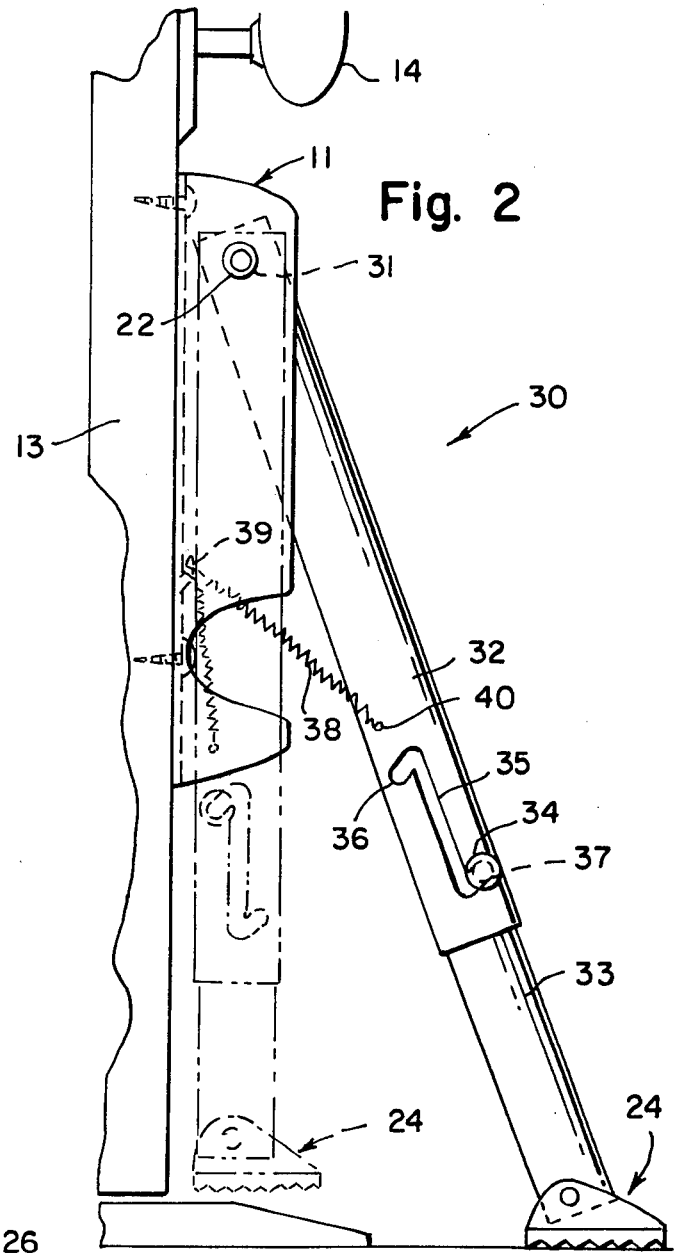
FIG. 2 is a similar side view of another design of the invention, shown installed on a door.
Figure 4:
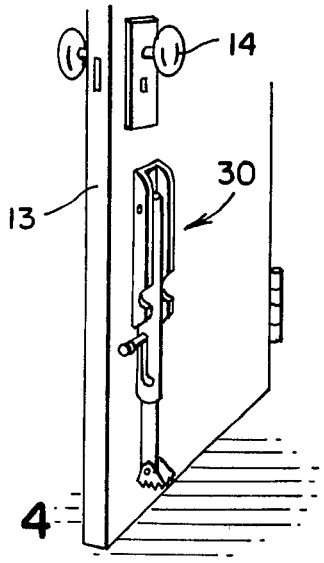
FIG. 4 is a perspective view of the invention model shown in FIG. 2.

Referring now to FIG. 2 and 4, another model 30 of the door prop, is quite similar to the model 10 described above except that in this design, the above described slots 18 are replaced by a hole 31 in each end wall 19, and the brace is made in two telescopic sections 32 and 33 which are secured together in either extended or retracted positions by a cross pin 34 in one section 33 being slidable in a single slot 35 made only on one side of the other section 32, the cross pin protruding outwardly of only one side of the section 32 so to be operated like a rifle bolt in sliding along the slot and then rotated a little so to lock in either terminal end 36 or 37 formed angularly at opposite ends of the slot.

A tension spring 38 between a hook 39 formed on the channel and a hole 40 along the brace, serves to pull the brace against the floor when in use to increase friction and prevent sliding.

FIG. 4 illustrates the door prop in the retracted inoperative position with the section 33 retained in its uppermost position with pin 34 in upper terminal 36 of section 32 which is held adjacent stationary brace 11 parallel to the door by the spring 38 and the weight of the prop.

While various changes may be made in the detail construction, it is understood that such changes will be within the spirit and scope of the present invention as is defined by the appended claims.

What is claimed:

1. A door prop to prevent door opening, comprising in combination, a base mounted under a door knob on a door, and a brace assembly supported from said base, said base comprising a channel with opposing end walls spaced within which said brace is secured, a lower end of said brace having a foot for frictional engagement upon a floor, and means for pivoting an upper end of said brace assembly on said channel and lowering said foot to engage the floor frictionally wherein said means comprises a cross pin through an upper end of said brace assembly being pivotable in a hole in each said end wall, whereby said brace assembly normally hangs vertically in said channel spaced from floor surface, said brace assembly including a foot guide pin bolt slidably mounted in a tube groove having upper and lower transverse terminals for retaining said foot in the position spaced from said floor surface and in an operative extended position abutting said floor surface.

2. A prop as in claim 1 wherein a spring is provided between said channel and said brace biasing said brace toward said channel.

* * * * *